US006203633B1

(12) United States Patent
Clauer et al.

(10) Patent No.: US 6,203,633 B1
(45) Date of Patent: Mar. 20, 2001

(54) LASER PEENING AT ELEVATED TEMPERATURES

(75) Inventors: Allan H. Clauer, Worthington; Steven M. Toller, Grove City, both of OH (US)

(73) Assignee: LSP Technologies, Inc., Dublin, OH (US)

( * ) Notice: Subject to any disclaimer, the term of this patent is extended or adjusted under 35 U.S.C. 154(b) by 0 days.

(21) Appl. No.: 09/134,115

(22) Filed: Aug. 14, 1998

(51) Int. Cl.[7] ..... C21D 1/09; B23K 26/00
(52) U.S. Cl. ..... 148/565; 219/121.85
(58) Field of Search ..... 148/525, 565; 219/121.85

(56) References Cited

U.S. PATENT DOCUMENTS 3,850,698 * 11/1974 Mallozzi et al. ..... 148/4
4,401,477 * 8/1983 Clauer et al. ..... 148/4
5,235,838 * 8/1993 Berstein ..... 148/510
5,741,559 * 4/1998 Dulaney ..... 427/554
5,879,480 * 3/1999 Hetzner ..... 148/644

OTHER PUBLICATIONS

"Heat Treating of Aluminum Alloys" ASM Handbook, vol. 4: Heat Treating, pp. 841, 851–855, Aug. 1991.*

* cited by examiner

*Primary Examiner*—George Wyszomierski
*Assistant Examiner*—Janelle Combs Morillo
(74) *Attorney, Agent, or Firm*—Randall J. Knuth

(57) ABSTRACT

A method of altering the properties of a solid material by varying the temperature of the solid material either before or after or both before and after laser shock processing the solid material. In addition, the method may be repeated for successive laser shock processing of the solid material.

18 Claims, 1 Drawing Sheet

LASER PEENING AT ELEVATED TEMPERATURES

BACKGROUND OF THE INVENTION

1. Field of the Invention

The present invention relates to the use of coherent energy pulses, as from high-powered pulsed lasers, in the shock processing of solid materials, and more particularly, a method for improving properties of solid materials by providing shock waves therein. The invention is especially useful for enhancing or creating desired physical properties such as hardness, strength, and fatigue strength.

2. Description of the Related Art

Older methods for the shock processing of solid materials typically involve the use of high-explosive materials in contact with the solid, or high-explosive materials or high-pressure gases to accelerate a plate that strikes a solid to produce shock waves therein. Such methods have several disadvantages. For example: (a) it is difficult and costly to shock process non-planar surfaces and complicated geometries, (b) storage and handling of the high-explosive materials and high-pressure gases pose a hazard, (c) the processes are difficult to automate and thus, fail to meet some industrial needs, and (d) high-explosive materials and high-pressure gases cannot be used in extreme environments such as high temperatures and high vacuum.

Shot peening is another widely known and accepted process for improving the fatigue, hardness, and corrosion resistance properties of materials by impact treatment of their surfaces. In shot peening, many small shots or beads are thrown at high-speed against the surface of a material. The shot or beads sometime escape from the treatment equipment and scatter in the surrounding area. Since the shot or beads might get into surrounding machinery and cause damage, shot peening usually cannot be used in a manufacturing line. Ordinarily, shot peening cannot be used on machined surfaces without a likelihood of damaging them. In addition, shot peening has problems maintaining consistency of treatment caused by inherent wear of the shot and the shot peening equipment.

Laser shock processing equipment, however, can be incorporated into manufacturing lines without damage to the surrounding equipment. Shock processing with coherent radiation has several advantages over what has been done previously. For example, the source of the radiation is highly controllable and reproducible. The radiation is easily focused on pre-selected surface areas and the operating mode is easily changed. This allows flexibility in the desired shocking pressure and careful control over the workpiece area to be shocked. Workpieces immersed in hostile environments, such as high temperature and high vacuum can be shock processed. Additionally, it is easy to shock the workpiece repetitively. This is desirable where it is possible to enhance material properties in a step-wise fashion.

Laser peening (here and after referred to as laser shock processing) utilizes two overlays: a transparent overlay (e.g. water) and an opaque layer, (e.g. an oil based or acrylic-based black paint). Processing is typically done with the workpiece at ambient or room temperature. During processing, a laser beam is directed to pass through the transparent overlay and is absorbed by the opaque layer, e.g. black paint, causing a rapid vaporization of the paint surface and the generation of a high amplitude shock wave. The shock wave cold-works the surface of the part and creates compressive residual stresses which provide an increase in fatigue properties of the part. A workpiece is typically processed by processing a matrix of overlapping spots that cover the fatigue critical zone of the part.

Solid materials subject to laser shock processing contain naturally occurring dislocations. These dislocations move through the matrix of the solid material when the solid material is subject to stresses such as bending or pounding. Laser shock processing introduces additional dislocations in the solid material which increase material strength and contribute to residual stress.

One problem with current methods of laser shock processing is that some solid materials, at room temperature, are too brittle to process. When laser processing of workpieces of these materials is done at ambient or room temperature, these material will crack or fracture. An example of a class of solid materials which are brittle at room temperatures, but whose ductility slowly increases with increasing temperatures, are many inter-metallic compounds. Therefore, these materials, as well as others, which may benefit from laser shock processing are prevented from being processed, because of their tendency to crack and break.

An additional problem with current methods of laser shock processing is the inability to modify the amount of compressive residual stresses previously introduced in a solid material by laser shock processing. Once the compressive residual stress is introduced in a solid material, the magnitude or amount of compressive residual stress cannot be altered via the current laser shock processing methods, particularly to reduce the magnitude, if desired.

SUMMARY OF THE INVENTION

The present invention is a method of varying the temperature of a solid material prior to, or subsequent to, laser shock processing. The present invention provides a method of increasing or decreasing the temperature of a solid material followed by laser shock processing. A separate method involves varying the temperature of the solid material subsequent to laser shock processing. In addition, the present invention includes a method of varying the temperature of a solid material both prior to laser shock processing as well as subsequent to laser shock processing. All of the methods of the present invention may be cycled or repeated to achieve the desired compressive residual stress or microstructural changes in the solid material. Furthermore, such methods may be used to create a gradient of stress, hardness, or other associated properties over the laser peened surface.

The invention, in one form thereof, is a method for altering the properties of a solid material by providing shock waves therein. The temperature of the solid material is changed. Laser peening introduces compressive residual stress in the solid material. In one particular embodiment, this process is repeated. In a separate embodiment, the temperature of the solid material is changed following a laser peening.

The invention, in another form thereof, is a method of altering the properties of a solid material by providing shockwaves therein. Laser peening introduces compressive residual stress in the solid material. The temperature of the solid material is changed following laser peening the solid material. In one particular embodiment, the temperature of the solid material is increased following laser peening. In an alternate embodiment, the temperature of the solid material is decreased following laser peening. In yet another embodiment, the process is repeated.

An advantage of the present invention is that the method allows solid material, which would otherwise not be suitable for laser shock processing at room temperature, to be laser shock processed. Some solid material, such as inter-metallic compounds, tend to be brittle at room temperature. Consequently, these metals are subject to cracking during room temperature laser shock processing. When these brittle metals are heated, they become more ductile and malleable. The malleability or ductility of the metal achieved by heating allows these metals to be laser shock processed without cracking.

Another advantage of the present invention is the ability to modify the amount of compressive residual stress introduced in a solid material when laser shock processed. The amount of residual stress introduced in a solid material may be enhanced by lowering the temperature of the solid material prior to laser shock processing. As a general rule, there is an increase in the compressive residual stress introduced in a solid material as the material strength increases. The material strength of a solid material can be increased by decreasing the temperature of that solid material. Since material strength increases as temperature decreases, decreasing the temperature of the solid material prior to laser shock processing would yield an increase in compressive residual stress as compared to laser shock processing at a higher temperature. Conversely, there would be a decrease in compressive residual stress introduced in a solid material by laser shock processing a solid material at a higher temperature as compared to the compression residual stress introduced by laser shock processing a solid material at a lower temperature.

A further advantage of the present invention is the ability to modify the strength or hardness of a laser peened surface layer which was previously introduced into a piece of solid material. Subsequent heating of a material in which a compressive residual stress has been introduced by laser peening may further increase the strength of the solid material by altering the microstructure of the solid material. Heating the solid material modifies its microstructure by allowing alloying elements to diffuse through the solid material's matrix. When the diffusing elements encounter a dislocation in the solid material's microstructure, they will tend to precipitate along the dislocation line. Laser peening introduces a high density of dislocations into the cold-worked surface layer containing the compressive residual stresses. This high density of dislocations creates numerous sites for precipitation, causing a closely spaced distribution of fine precipitates in the material matrix. The combination of the high density of dislocations and this dispersion of fine precipitates often significantly increases the strength of the worked material. The precipitates retard the ability for dislocations to migrate through the solid material's matrix, and thereby enhance the strength of the solid material.

A yet further advantage of the present invention is the ability to reduce the amount of compressive residual stress which has been introduced in a piece of solid material. Sufficient heating of a solid material in which compressive residual stress has been introduced relaxes the introduced compressive residual stress. Therefore, the amount of compressive residual stress can be decreased by post-laser shock processing heating of the solid material.

Another advantage of the present invention is the ability to create a controlled strength gradient over the surface of a solid material. Heating an area subsequent to laser shock processing may either increase or decrease the amount of compressive residual stress and material strength. Depending on how much heat and its duration is applied and the type of material subject to laser shock processing, the amount of residual stress or material strength will either be enhanced or reduced. By directing the appropriate amount of heating and/or cooling to selected areas subjected to laser peening, a stress or strength gradient can be achieved.

A further advantage of the present invention is the cycling or repeating of a laser peening process while varying the temperature of the solid material being processed. The method of laser peening followed by heating described above can be extended to provide additional increases in strength, and possibly increases in ductility, of the surface layer and the workpiece. By appropriate selection of the intensity of laser peening followed by heating to specific temperatures for specific times, different combinations of strength and ductility can be achieved. This has been termed "thermo-mechanical" processing of metals, i.e. specific combinations of repeated successive mechanical plastic deformations of an alloy and heat treatments tailored to enhance metal strength and ductility.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding steps throughout the flow charts. The exemplification set out herein illustrates one preferred embodiment of the invention, in one form, and such exemplification is not to be construed as limiting the scope of the invention in any manner.

DETAILED DESCRIPTION OF THE INVENTION

The improvements in fatigue life may be produced by shock processing which results in compressive residual stresses developed in the surface of the processed material retarding fatigue, crack initiation and/or slowing the crack propagation rate. A crack front is the leading edge of a crack as it propagates through a solid material. Changes in the shape of a crack front and slowing of the crack growth rate when the crack front encounters the shocked zone in a shock processed condition have been shown. One method of introducing compressive residual stresses is laser shock processing.

Laser shock processing is an effective method of increasing fatigue life in metals by treating fatigue critical regions. As to what effect the tensile residual stresses surrounding the laser shocked region would have on crack initiation, a previous study is described in "Shock Waves and High Strained Rate Phenomenon in Metals" by A. H. Clauer, J. H. Holbrook, and B. P. Fairand, E. D. by M. S. Myers and L. E. Murr, Plenum Press, New York (1981) pp. 675–702.

Some very strong metals are also quite brittle at room temperature. Consequently, these metals are not good candidates for shock processing. A class of metals which possess brittleness at room temperature includes inter-metallic compounds. Some examples of inter-metallic compounds include gamma titanium aluminide, nickel aluminide (NiAl), nickel 3-aluminide ($Ni_3AL$), titanium aluminide (TiAl), and iron aluminides (FeAl). While these metals are brittle at room temperature, they become more ductile as they are heated. Other somewhat brittle materials include quenched and high-carbon steels, white cast iron, and other alloys in specific cast or heat-treated conditions. This class of materials also includes ceramics, i.e., materials existing as compounds such as oxides, carbides, nitrides, and combinations thereof.

Figure 1:
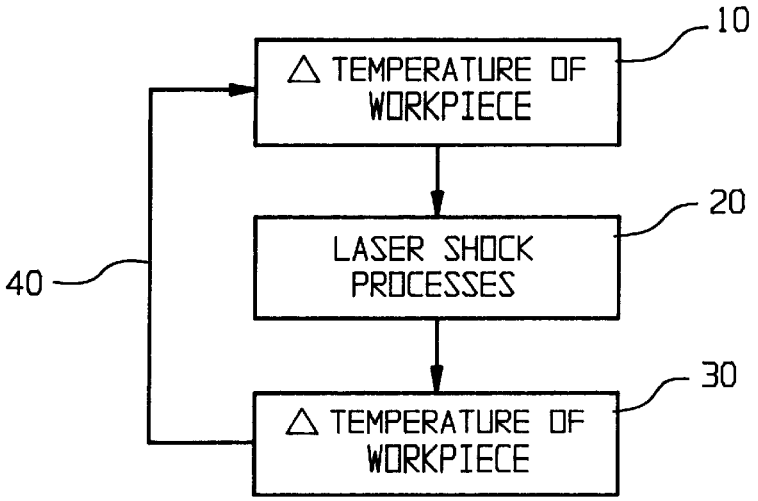
FIG. 1 is a flow chart depicting one method of the present invention.

Referring to FIG. 1, in one method of the invention, the temperature of a solid material or workpiece is either increased or decreased (10) to a pre-laser shock processing temperature. To increase the ductility of a work piece, the temperature of the workpiece may be increased. The increase in temperature reduces the brittleness of the workpiece and consequently reduces the possibility of the workpiece cracking during the subsequent laser shock processing. Next, the heated workpiece is subject to laser shock processing (20). Then, the temperature of the workpiece is either increased or decreased (30) to a post-laser processing temperature.

The magnitude of compressive residual stress may be increased by lowering the temperature of the workpiece (10) prior to laser shock processing (20). The temperature of the workpiece may be changed by decreasing the workpiece's temperature (10). As the temperature of the workpiece decreases, the strength of the material increases. Subsequent shock processing (20) of a cooled workpiece may yield an increase in compressive residual stress and hardness or strength of the surface as compared to shock processing a workpiece at a higher temperature, such as room or elevated temperature.

In addition to altering the temperature of a workpiece by increasing or decreasing the temperature before laser shock processing, the temperature of the workpiece can be increased or decreased subsequent to shock processing (30).

The microstructure of the workpiece may be altered subsequent to laser shock processing (20). The material strength of the workpiece may be enhanced by subsequently heating the work piece following laser shock processing. The laser shock processing (20) introduces compressive residual stress and a high density of dislocations into a workpiece, in addition to the naturally occurring dislocations found within the matrix of a workpiece. Metal alloy workpieces will also contain alloying elements which often are intended to form a precipitation of compound particles dispersed through the matrix. Dislocations move through the crystal lattice of the workpiece metal when the metal is subjected to deformation, such as bending or pounding. When a dislocation encounters a precipitate particle, the dislocation motion is halted or slowed, thus strengthening the metal. For example, a metal alloy workpiece having precipitate alloying elements dissolved in the metal matrix, with no fine dispersion of precipitates, can be strengthened by laser peening followed by heat treatment of the workpiece. Post-laser peening heating of the metal workpiece permits the alloying elements to move through the metal lattice. Consequently, the alloying elements precipitate along both the naturally occurring and the laser-shock-induced dislocations.

The more precipitate particles in the pathway of migrating dislocations, the harder it is to bend a metal workpiece. Therefore, the strength of a metal workpiece is increased when a fine dispersion of precipitates forms along the dislocations. The high dislocation density fosters the precipitation of numerous, small precipitates within the matrix, thereby enhancing the workpiece's strength.

A residual stress or strength gradient may be created along the surface of a workpiece by varying the temperature of the workpiece subsequent to shock processing. By directing heat to a specific portion of the laser peened region on the workpiece, that heated location may have its microstructure altered. Depending on how much heat is applied, the microstructure of the workpiece will be altered to a varying degree. For example, applying heat to a specific area of a workpiece subsequent to laser shock processing may increase the strength of the workpiece at that location. Conversely, the area of the workpiece not subject to heating may have a different strength. Consequently, a strength gradient is created.

A strength gradient would be desirable where a distribution of surface compressive residual stress is needed, and where there are localized areas in which further surface hardness and wear resistance are required. In this section, such as aircraft structures, engine casings, struts, etc., the increase in strength and hardness will extend through the thickness, greatly enhancing the strength and hardness in the local area, for example, around a hole in a structure.

Depending on the workpiece's material and the amount of heat applied to the workpiece subsequent to laser shock processing, there may be a decrease in stresses introduced into the workpiece by shock processing. The process of recovery and stress relaxation occurs when a workpiece subsequent to laser shock processing is heated to a high enough temperature whereby the compressive residual stress decreases. Therefore, heating a workpiece high enough to achieve recovery or relaxation may be used to modify the amount of compressive residual stress introduced into a workpiece. In addition, this process can be used to create a strength gradient in the surface. By directing enough heat to a specific location on a workpiece such that recovery and relaxation of the induced compressive residual stress occurs, while retaining locations where recovery and relaxation have not occurred, sets up a surface and strength gradient.

In addition to increasing the temperature of the workpiece subsequent to shock processing, it may be advantageous to decrease the temperature of the workpiece (30). This may include either returning the temperature of the workpiece to ambient or room temperature or decreasing the temperature of the workpiece below ambient or room temperature.

For example, some solid material such as some steels, may contain incompletely transformed austenite at room temperature Austenite is a crystallographic phase within a steel alloy's matrix whose transformation to martensite during cooling increases a steel's hardness. When laser shock processing is used to introduce compressive residual stress in some steels, the steels may still contain incompletely transformed austenite. Subsequent cooling following laser shock processing may further transform the austenites into martensite and increase material hardness. Use on other materials for similar or other reasons is also possible.

The process can be cycled or repeated (40) as necessary to achieve the desired compressive residual stress level and material strength. For example, it may be advantageous to increase the temperature of the workpiece (10), laser shock process the workpiece (20), decrease the temperature of the workpiece (30), and repeat the process (40). The pre and post-laser shock processing temperatures for successive laser shock processing treatments can be the same as the pre- and post-laser shock processing temperatures used the first time through the process or the pre- and post-laser processing temperatures of the workpiece can be different during successive laser shock processing cycles.

The advantage of altering the pre- and post-laser shock processing temperatures of the workpiece between successive laser shock processing is that the response of the metal alloy microstructure to temperature changes is dependent on the prior mechanical and thermal history. Therefore, after the first cycle of laser peening and heating and cooling, the material microstructure has been altered. Subsequent laser peening, heating, and cooling cycles must take these changes into account when optimizing the conditions imposed for maximizing property benefits.

The advantage of changing the temperature of the workpiece from a post-laser processing temperature to a different, pre-laser processing temperature for a successive laser shock processing cycle is that the effects of laser peening on the compressive residual stresses, strength, hardness, and response to post-laser processing temperature change are dependent on the temperature of the material when laser processed. The density and distribution of dislocations and point defects introduced by laser peening will depend on the laser peening temperature and the prior history. For example, lowering the laser peening temperature would usually introduce a different dislocation distribution in the material microstructure use than higher temperature laser peening, and this would result in a different size and distribution of precipitates during post-laser processing heating; and so on during successive laser-peening cycles.

Figure 2:
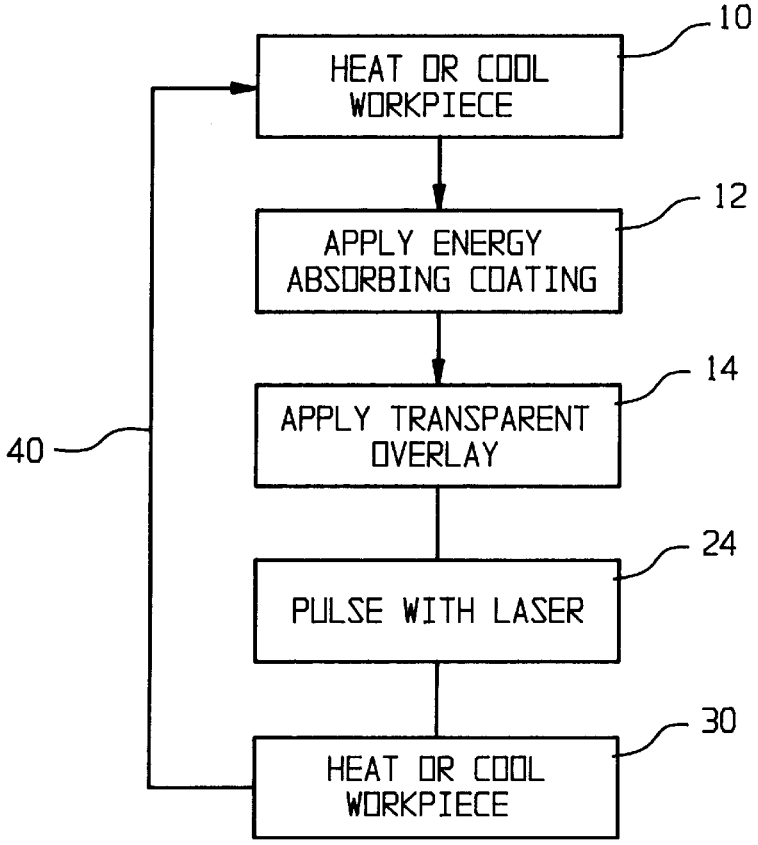
FIG. 2 is a flow chart depicting of another method of the present invention.

Referring to FIG. 2, the method of inducing compressive residual stresses into the workpiece includes applying an energy absorbing coating (12), applying a transparent overlay (14), and pulsing the workpiece with a laser (24). Applying an energy absorbing coating (12) and applying a transparent overlay (14) may be performed before or after heating or cooling the workpiece (10). A laser energy absorbing coating (12), for example a water-based black paint or other suitable material, is applied to a particular location on the workpiece to be laser shocked processed. Next, a transparent overlay material is applied (14) to the previously coated portion of the workpiece. Subsequently, a laser beam is used to direct a laser energy pulse at the location where an energy absorbing coating was previously applied to the workpiece (24). The overlays could be removed after laser peening but before further heating or cooling.

While the method disclosed here includes the steps of varying the temperature of the workpiece before and after shock processing, it may be advantageous to alter or vary the temperature of the workpiece only before, or only after, subjecting the workpiece to shock processing.

While this invention has been described as having a preferred method, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of altering the properties of a solid material by providing shock waves therein, comprising the steps:

changing the temperature of the solid material to a first increased temperature above room temperature;

introducing compressive residual stress in the solid material at said first temperature by laser peening.

2. The method of claim 1 further comprising the step:

changing the temperature of the solid material following the step of introducing compressive residual stress in the solid material by laser peening.

3. The method of claim 2 in which said step of changing the temperature of the solid material following the step of introducing compressive residual stress in the solid material by laser peening comprises increasing the temperature of the solid material.

4. The method of claim 2 further in which changing the temperature of the solid material following the step of introducing compressive residual stress in the solid material by laser peening comprises decreasing the temperature of the solid material.

5. The method of claim 1 in which the process is repeated.

6. A method of claim 1 wherein laser peening comprises the steps:

applying an energy absorbing coating to a portion of the surface of the solid material;

applying a transparent overlay material to said coating portion of the solid material; and directing a pulse of coherent energy to said coated portion of the solid material to create a shock wave.

7. The method of claim 6 in which said step of changing the temperature of the solid material comprises increasing the temperature of the solid material.

8. The method of claim 6 in which said step of changing the temperature of the solid material comprises decreasing the temperature of the solid material.

9. The method of claim 6 further comprising the step:

changing the temperature of the solid material following the step of directing a pulse of coherent energy to said coated portion of the solid material to create a shock wave.

10. The method of claim 6 in which the process is repeated.

11. The method of claim 7 further comprising the step:

changing the temperature of the solid material following the step of directing a pulse of coherent energy to said coated portion of the solid material to create a shock wave.

12. The method of claim 8 further comprising the step:

changing the temperature of the solid material following the step of directing a pulse of coherent energy to said coated portion of the solid material to create a shock wave.

13. The method of claim 9 in which said step of changing the temperature of the solid material following the step of directing a pulse of coherent energy to said coated portion of the solid material to create a shock wave comprises increasing the temperature of the solid material.

14. The method of claim 9 further in which changing the temperature of the solid material following the step of directing a pulse of coherent energy to said coated portion of the solid material to create a shock wave comprises decreasing the temperature of the solid material.

15. The method of claim 11 in which changing the temperature of the solid material following the step of directing a pulse of coherent energy to said coated portion of the solid material to create a shock wave comprises increasing the temperature of the solid material.

16. The method of claim 11 in which changing the temperature of the solid material following the step of directing a pulse of coherent energy to said coated portion of the solid material to create a shock wave comprises decreasing the temperature of the solid material.

17. The method of claim 12 in which changing the temperature of the solid material following the step of directing a pulse of coherent energy to said coated portion of the solid material to create a shock wave comprises increasing the temperature of the solid material.

18. The method of claim 12 in which changing the temperature of the solid material following the step of directing a pulse of coherent energy to said coated portion of the solid material to create a shock wave comprises decreasing the temperature of the solid material.

* * * * *